US009779749B2

(12) United States Patent
Miao et al.

(10) Patent No.: US 9,779,749 B2
(45) Date of Patent: *Oct. 3, 2017

(54) AUDIO SIGNAL CODING METHOD AND APPARATUS

(71) Applicant: Huawei Technologies Co., Ltd., Shenzhen (CN)

(72) Inventors: Lei Miao, Beijing (CN); Zexin Liu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/341,451

(22) Filed: Nov. 2, 2016

(65) Prior Publication Data

US 2017/0053661 A1 Feb. 23, 2017

Related U.S. Application Data

(63) Continuation of application No. 15/011,824, filed on Feb. 1, 2016, now Pat. No. 9,514,762, which is a (Continued)

(30) Foreign Application Priority Data

Oct. 8, 2011 (CN) ..... 2011 1 0297791

(51) Int. Cl.
*G10L 19/00* (2013.01)
*G10L 19/26* (2013.01)
(Continued)

(52) U.S. Cl.
CPC ..... *G10L 19/265* (2013.01); *G10L 19/008* (2013.01); *G10L 19/0204* (2013.01);
(Continued)

(58) Field of Classification Search
USPC ..... 704/200–232, 500–504
See application file for complete search history.

(56) References Cited

U.S. PATENT DOCUMENTS 6,134,518 A * 10/2000 Cohen ..... G10L 19/18 704/201
2004/0064311 A1 4/2004 Sinha et al.
(Continued)

FOREIGN PATENT DOCUMENTS

CN 1498396 A 5/2004
CN 1942928 A 4/2007
(Continued)

OTHER PUBLICATIONS

Neuendorf et al. "Unified Speech and Audio Coding Scheme for High Quality at Low Bitrates". IEEE Int. Conf. on Acoustics, Speech, and Signal Proc., 2009.*
(Continued)

*Primary Examiner* — Jesse Pullias
(74) *Attorney, Agent, or Firm* — Conley Rose, P.C.

(57) ABSTRACT

The present disclosure relates to an audio signal coding method and apparatus. The method includes categorizing audio signals into high-frequency audio signals and low-frequency audio signals, coding the low-frequency audio signals using a corresponding low-frequency coding manner according to characteristics of low-frequency audio signals, and selecting a bandwidth extension mode to code the high-frequency audio signals according to the low-frequency coding manner and/or characteristics of the audio signals.

11 Claims, 6 Drawing Sheets

Related U.S. Application Data continuation of application No. 14/145,632, filed on Dec. 31, 2013, now Pat. No. 9,251,798, which is a continuation of application No. PCT/CN2012/072792, filed on Mar. 22, 2012.

(51) Int. Cl.

| | |
|---|---|
| ***G10L 19/18*** | (2013.01) |
| ***G10L 21/038*** | (2013.01) |
| ***G10L 19/008*** | (2013.01) |
| ***G10L 19/02*** | (2013.01) |
| ***G10L 19/087*** | (2013.01) |
| *G10L 25/18* | (2013.01) |

(52) U.S. Cl.

CPC ..... *G10L 19/087* (2013.01); *G10L 19/18* (2013.01); *G10L 21/038* (2013.01); *G10L 25/18* (2013.01)

(56) References Cited

U.S. PATENT DOCUMENTS

| | | | | |
|---|---|---|---|---|
| 2005/0108009 | A1 | 5/2005 | Lee et al. | |
| 2006/0149538 | A1 | 7/2006 | Lee et al. | |
| 2006/0282262 | A1 | 12/2006 | Vos et al. | |
| 2007/0299656 | A1 | 12/2007 | Son et al. | |
| 2009/0107322 | A1 | 4/2009 | Akiyama | |
| 2010/0017202 | A1 | 1/2010 | Sung et al. | |
| 2010/0094638 | A1 | 4/2010 | Lee et al. | |
| 2011/0099018 | A1 | 4/2011 | Neuendorf et al. | |
| 2012/0010880 | A1* | 1/2012 | Nagel ..... | G10L 19/18 704/205 |

FOREIGN PATENT DOCUMENTS

| | | | |
|---|---|---|---|
| CN | 101140759 | A | 3/2008 |
| CN | 101572087 | A | 11/2009 |
| CN | 101896968 | A | 11/2010 |
| CN | 102150200 | A | 8/2011 |
| EP | 2056294 | A2 | 5/2009 |
| EP | 2302345 | A1 | 3/2011 |
| JP | 2006293400 | A | 10/2006 |
| JP | 2007532963 | A | 11/2007 |
| JP | 2009104015 | A | 5/2009 |
| JP | 2009541790 | A | 11/2009 |
| JP | 2011514558 | A | 5/2011 |
| WO | 02058052 | A1 | 7/2002 |
| WO | 2005040749 | A1 | 6/2005 |
| WO | 2005101372 | A1 | 10/2005 |
| WO | 2006049204 | A1 | 5/2006 |
| WO | 2011043227 | A1 | 4/2011 |

OTHER PUBLICATIONS

Nagel et al. "A Harmonic Bandwidth Extension Method for Audio Codecs". IEEE Int. Conf. on Acoustics, Speech, and Signal Proc., 2009.*

Machine Translation and Abstract of Chinese Publication No. CN101140759, Mar. 12, 2008, 12 pages.

Machine Translation and Abstract of Japanese Publication No. JP2006293400, Oct. 26, 2006, 33 pages.

Machine Translation and Abstract of Japanese Publication No. JP2009104015, May 14, 2009, 24 pages.

Machine Translation and Abstract of Japanese Publication No. JP2007532963, Nov. 15, 2007, 46 pages.

Machine Translation and Abstract of Japanese Publication No. JP2011514558, May 6, 2011, 45 pages.

Tancerel, L., et al., "Combined Speech and Audio Coding by Discrimination," Proceedings IEEE Workshop on Speech Coding, Sep. 17-20, 2000, pp. 154-156.

"Series G: Transmission Systems and Media, Digital Systems and Networks, Digital terminal equipment—Coding of analogue signals by methods other than PCM, G.729-based embedded variable bit-rate coder: An 8-32 kbit/s scalable wideband coder bitstream interoperable with G.729," ITU-T, G.729.1, May 2006, 100 pages.

"Series G: Transmission Systems and Media, Digital Systems and Networks, Digital terminal equipments—Coding of voice and audio signals, 7 kHz audio-coding within 64 kbit/s: New Annex B with superwideband embedded extension, Amendment 1," ITU-T, G.722, Amendment 1, Nov. 2010, 96 pages.

"Series G: Transmission Systems and Media, Digital Systems and Networks, Digital terminal equipments—Coding of analogue signals by methods other than PCM, Coding at 24 and 32 kbit/s for hands-free operation in systems with low frame loss, Corrigendum 1," ITU-T, G.722.1, Corrigendum 1, Nov. 2000, 10 pages.

"Series G: Transmission Systems and Media, Digital Systems and Networks, Digital terminal equipments—Coding of voice and audio signals, Wideband embedded extension for G.711 PCM: New Annex D with superwideband extension, Amendment 4," ITU-T, G.711.1, Amendment 4, 74 pages.

Foreign Communication From a Counterpart Application, European Application No. 12793206.9, European Result of consultation dated Oct. 11, 2016, 5 pages.

Foreign Communication From a Counterpart Application, Chinese Application No. 201110297791.5, Chinese Office Action dated May 4, 2014, 6 pages.

Foreign Communication From a Counterpart Application, European Application No. 12793205.9, Extended European Search Report dated Jul. 31, 2014, 6 pages.

Foreign Communication From a Counterpart Application, European Application No. 12793206.9, European Oral Proceedings dated Mar. 2, 2016, 6 pages.

Foreign Communication From a Counterpart Application, Japanese Application No. 2013-555743, Japanese Office Action dated Jul. 1, 2014, 3 pages.

Foreign Communication From a Counterpart Application, Japanese Application No. 2013-555743, English Translation of Japanese Office Action dated Jul. 1, 2014, 3 pages.

Foreign Communication From a Counterpart Application, Japanese Application No. 2015-010546, Japanese Report on Reconsideration dated Aug. 27, 2015, 4 pages.

Foreign Communication From a Counterpart Application, Japanese Application No. 2015-010546, English Translation of Japanese Report of Pre-Appeal Review dated Aug. 27, 2015, 4 pages.

Foreign Communication From A Counterpart Application, PCT Application No. PCT/CN2012/072792, English Translation of International Search Report dated Jul. 5, 2012, 4 pages.

Foreign Communication From A Counterpart Application, PCT Application No. PCT/CN2012/072792, English Translation of Written Opinion dated Jul. 5, 2012, 5 pages.

Office Action dated Jun. 9, 2015, 41 pages, U.S. Appl. No. 14/145,632, filed Dec. 31, 2013.

* cited by examiner

AUDIO SIGNAL CODING METHOD AND APPARATUS

CROSS-REFERENCE TO RELATED APPLICATIONS

This application is a continuation of U.S. patent application Ser. No. 15/011,824 filed on Feb. 1, 2016, which is a continuation of U.S. patent application Ser. No. 14/145,632, filed on Dec. 31, 2013, now U.S. Pat. No. 9,251,798, which is a continuation of International Patent Application No. PCT/CN2012/072792, filed on Mar. 22, 2012, which claims priority to Chinese Patent Application No. 201110297791.5, filed on Oct. 8, 2011. All of the afore-mentioned patent applications are hereby incorporated by reference in their entireties.

FIELD OF THE INVENTION

The present disclosure relates to the field of communications, and in particular, to an audio signal coding method and apparatus.

BACKGROUND

During audio coding, considering the bit rate limitation and audibility characteristics of human ears, information of low-frequency audio signals is preferably coded and information of high-frequency audio signals is discarded. However, with the rapid development of the network technology, the network bandwidth limitation is being reduced. Meanwhile people's requirements for the timbre are higher and higher, and people desire to restore the information of the high-frequency audio signals by adding the bandwidth for the signals. In this way, the timbre of the audio signals is improved. In an embodiment, this may be implemented using bandwidth extension (BWE) technologies.

Bandwidth extension may extend the frequency scope of the audio signals and improve signal quality. At present, the commonly used BWT technologies include, for example, the time domain (TD) bandwidth extension algorithm in G.729.1, the spectral band replication (SBR) technology in moving picture experts group (MPEG), and the frequency domain (FD) bandwidth extension algorithm in International Telecommunication Union (ITU-I) G.722B/G.722.1D.

FIG. 1 and FIG. 2 are schematic diagrams of bandwidth extension. That is, no matter whether the low-frequency (for example, smaller than 6.4 kilohertz (kHz)) audio signals use TD coding or FD coding, the high-frequency (for example, 6.4-16/14 kHz) audio signals use TD-BWE or FD-BWE for bandwidth extension.

In the prior art, only TD coding of the TD-BWE or FD coding of the FD-BWE is used to code the high-frequency audio signal, without considering the coding manner of the low-frequency audio signal and the characteristics of the audio signal.

SUMMARY OF THE DISCLOSURE

Embodiments of the present disclosure provide an audio signal coding method and apparatus, which are capable of implementing adaptive coding instead of fixed coding.

An embodiment of the present disclosure provides an audio signal coding method, where the method includes categorizing audio signals into high-frequency audio signals and low-frequency audio signals, coding the low-frequency audio signals using a corresponding low-frequency coding manner, and selecting a bandwidth extension mode to code the high-frequency audio signals according to the low-frequency coding manner and/or characteristics of the audio signals.

An embodiment of the present disclosure provides an audio signal coding apparatus, where the apparatus includes a categorizing unit configured to categorize audio signals into high-frequency audio signals and low-frequency audio signals, a low-frequency signal coding unit configured to code the low-frequency audio signals using a corresponding low-frequency coding manner, and a high-frequency signal coding unit configured to select a bandwidth extension mode to code the high-frequency audio signals according to the low-frequency coding manner and/or characteristics of the audio signals.

According to the audio signal coding method and apparatus in the embodiments of the present disclosure, the coding manner for bandwidth extension to the high-frequency audio signals may be determined according to the coding manner of the low-frequency audio signals and/or the characteristics of the audio signals. In this way, a case that the coding manner of the low-frequency audio signals and the characteristics of the audio signals are not considered during bandwidth extension can be avoided, bandwidth extension is not limited to a single coding manner, adaptive coding is implemented, and audio coding quality is improved.

DETAILED DESCRIPTION OF THE EMBODIMENTS

The following describes the technical solutions of the present disclosure in combination with the accompanying drawings and embodiments.

According to the embodiments of the present disclosure, whether TD-BWE or FD-BWE is used in frequency band extension may be determined according to a coding manner of low-frequency audio signals and characteristics of audio signals.

In this way, when low-frequency coding is TD coding, the TD-BWE or FD-BWE may be used for high-frequency coding, when the low-frequency coding is FD coding, the TD-BWE or FD-BWE may be used for the high-frequency coding.

Figure 1:
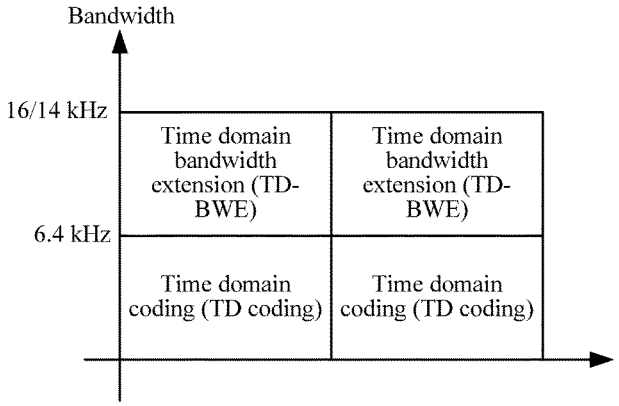
FIG. 1 PRIOR ART
FIG. 1 is a first schematic diagram of bandwidth extension in the prior art.
Figure 2:
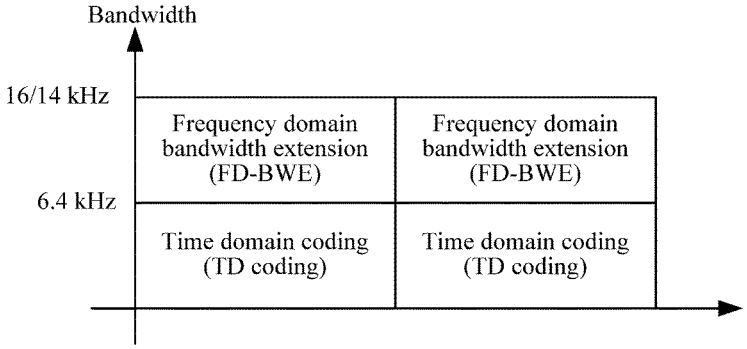
FIG. 2 PRIOR ART
FIG. 2 is a second schematic diagram of bandwidth extension in the prior art.
Figure 3:
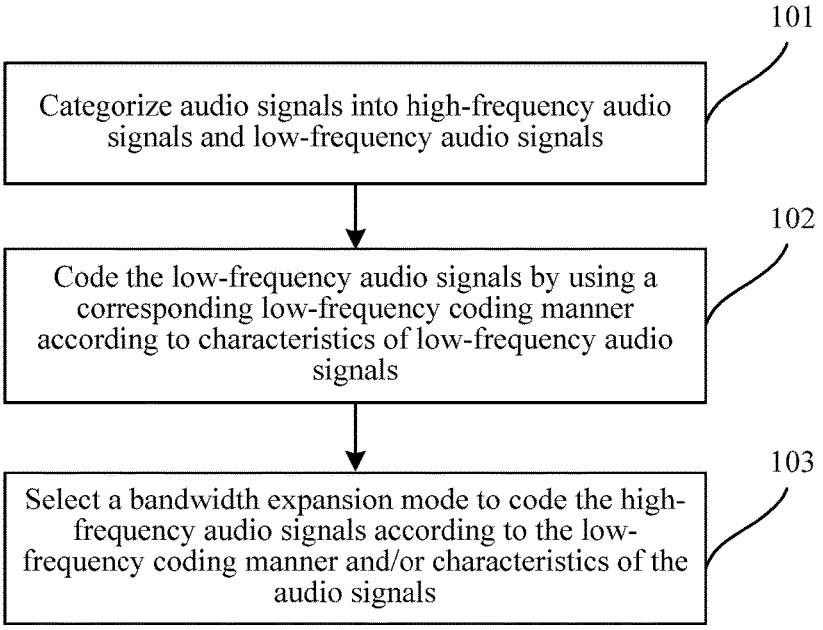
FIG. 3 is a flowchart of an audio signal coding method according to an embodiment of the present disclosure.

FIG. 3 is a flowchart of an audio signal coding method according to an embodiment of the present disclosure. As shown in FIG. 3, the audio signal coding method according to this embodiment of the present disclosure includes the following steps:

Step 101: Categorize audio signals into high-frequency audio signals and low-frequency audio signals.

The low-frequency audio signals need to be directly coded, whereas the high-frequency audio signals must be coded through bandwidth extension.

Step 102: Code the low-frequency audio signals using a corresponding low-frequency coding manner according to characteristics of the low-frequency audio signals.

The low-frequency audio signals may be coded in two manners, that is, TD coding or FD coding. For example, as regard voice audio signals, low-frequency voice signals are coded using TD coding, as regard music audio signals, low-frequency music signals are coded using FD coding. Generally, a better effect is achieved when voice signals are coded using TD coding, for example, code excited linear prediction (CELP), whereas a better effect is achieved when music signals are coded using FD coding, for example, modified discrete cosine transform (MDCT) or fast Fourier transform (FFT).

Step 103: Select a bandwidth extension mode to code the high-frequency audio signals according to the low-frequency coding manner or characteristics of the audio signals.

This step describes several possibilities in the case of coding the high-frequency audio signals first, determining a coding manner of the high-frequency audio signals according to the coding manner of the low-frequency audio signals, second, determining the coding manner of the high-frequency audio signals according to the characteristics of the audio signals, third, determining the coding manner of the high-frequency audio signals according to both the coding manner of the low-frequency audio signals and the characteristics of the audio signals.

The coding manner of the low-frequency audio signals may be the TD coding or the FD coding. However, the characteristics of the audio signals may be voice audio signals or music audio signals. The coding manner of the high-frequency audio signals may be a TD-BWE mode or a FD-BWE mode. As regard bandwidth extension of the high-frequency audio signals, coding needs to be performed according to the coding manner of the low-frequency audio signals or the characteristics of the audio signals.

A bandwidth extension mode is selected to code the high-frequency audio signals according to the coding manner of the low-frequency audio signal or the characteristics of the audio signals. The selected bandwidth extension mode corresponds to the low-frequency coding manner or the characteristics of the audio signals, the selected bandwidth extension mode and the low-frequency coding manner belonging to the same domain coding manner or the selected bandwidth extension mode and the characteristics of the audio signals belonging to the same domain coding manner.

In an embodiment, the selected bandwidth extension mode corresponds to the low-frequency coding manner. When the low-frequency audio signals should be coded using the TD coding manner, the TD-BWE mode is selected to perform TD coding for the high-frequency audio signals, when the low-frequency audio signals should be coded using the FD coding manner, the FD-BWE mode is selected to perform FD coding for the high-frequency audio signals. That is, the coding manner of the high-frequency audio signals and the low-frequency coding manner belong to the same domain coding manner (TD coding or FD coding).

In another embodiment, the selected bandwidth extension mode corresponds to the low-frequency coding manner suitable for the characteristics of the audio signals. When the audio signals are voice signals, the TD-BWE mode is selected to perform TD coding for the high-frequency audio signals, when the audio signals are music signals, the FD-BWE mode is selected to perform FD coding for the high-frequency audio signals. That is, the coding manner of the high-frequency audio signals and the low-frequency coding manner that is suitable for the characteristics of the audio signals belong to the same domain coding manner (TD coding or FD coding).

In still another embodiment, with comprehensive consideration of the low-frequency coding manner and the characteristics of the audio signals, a bandwidth extension mode is selected to code the high-frequency audio signals When the low-frequency audio signals should be coded using the TD coding manner and the audio signals are voice signals, the TD-BWE mode is selected to perform TD coding for the high-frequency audio signals, otherwise, the FD-BWE mode is selected to perform FD coding for the high-frequency audio signals.

Figure 4:
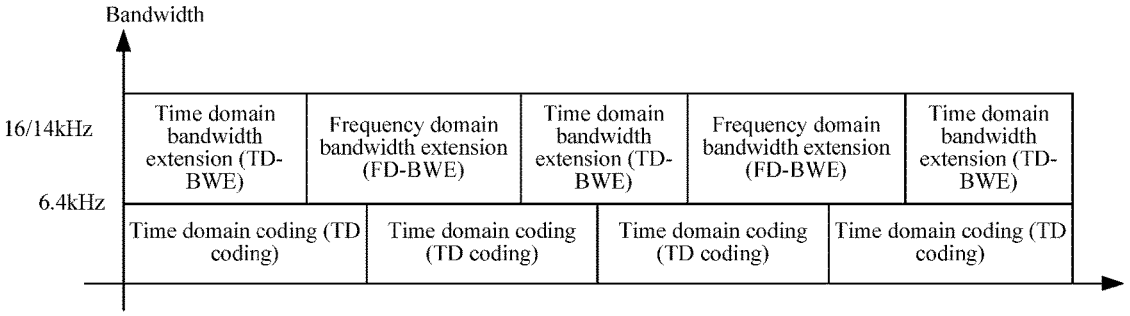
FIG. 4 is a first schematic diagram of bandwidth extension in the audio signal coding method according to an embodiment of the present disclosure.

Referring to FIG. 4, a first schematic diagram of bandwidth extension in the audio signal coding method according to an embodiment of the present disclosure is illustrated. Low-frequency audio signals, for example, audio signals at 0-6.4 kHz, may be coded using TD coding or FD coding. Bandwidth extension of high-frequency audio signals, for example, audio signals at 6.4-16/14 kHz, may be TD-BWE or FD-BWE.

That is to say, in the audio signal coding method according to the embodiment of the present disclosure, a coding manner of the low-frequency audio signals and bandwidth extension of the high-frequency signals are not in one-to-one correspondence. For example, if the low-frequency audio signals are coded using the TD coding, the bandwidth extension of the high-frequency audio signals may be the TD-BWE, or may be the FD-BWE, if the low-frequency audio signals are coded using the FD coding, the bandwidth extension of the high-frequency audio signals may be the TD-BWE, or may be the FD-BWE.

Figure 5:
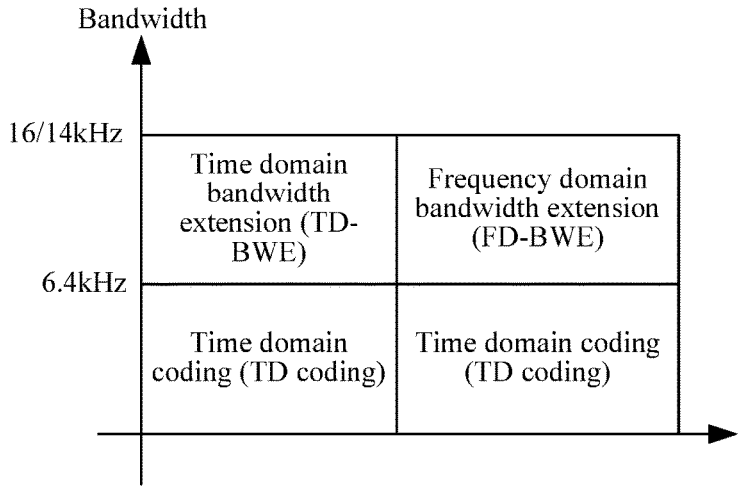
FIG. 5 is a second schematic diagram of bandwidth extension in the audio signal coding method according to an embodiment of the present disclosure.

In an embodiment, a manner for selecting a bandwidth extension mode to code the high-frequency audio signals is to perform processing according to the low-frequency coding manner of the low-frequency audio signals. For details, reference is made to a second schematic diagram of bandwidth extension in the audio signal coding method according to an embodiment of the present disclosure illustrated in FIG. 5. When the low-frequency (0-6.4 kHz) audio signals are coded using the TD coding, the high-frequency (6.4-16/14 kHz) audio signals are also coded using the TD coding of the TD-BWE, when the low-frequency (0-6.4 kHz) audio signals are coded using the FD coding, the high-frequency (6.4-16/14 kHz) audio signals are also coded using the FD coding of the FD-BWE.

Therefore, when the coding manner of the high-frequency audio signals and the coding manner of the low-frequency audio signals belong to the same domain, reference is not made to the characteristics of the audio signals/low-frequency audio signals. That is, the coding of the high-frequency audio signals is processed by referring to the coding manner of the low-frequency audio signals, instead of referring to the characteristics of the audio signals/low-frequency audio signals.

The coding manner for bandwidth extension to the high-frequency audio signals is determined according to the coding manner of the low-frequency audio signals such that a case that the coding manner of the low-frequency audio signals is not considered during bandwidth extension can be avoided, the limitation caused by bandwidth extension to the coding quality of different audio signals is reduced, adaptive coding is implemented, and the audio coding quality is optimized.

Another manner for selecting the bandwidth extension mode to code the high-frequency audio signals is to perform processing according to the characteristics of the audio signals or low-frequency audio signals. For example, if the audio signals/low-frequency audio signals are voice audio signals, the high-frequency audio signals are coded using the TD coding, if the audio signals/low-frequency audio signals are music audio signals, the high-frequency audio signals are coded using the FD coding.

Still referring to FIG. 4, the coding for bandwidth extension of the high-frequency audio signal is performed by referring only to the characteristics of the audio signals/low-frequency audio signals, regardless of the coding manner of the low-frequency audio signals. Therefore, when the low-frequency audio signals are coded using the TD coding, the high-frequency audio signal may be coded using the TD coding or the FD coding, when the low-frequency audio signals are coded using the FD coding, the high-frequency audio signals may be coded using the FD coding or the TD coding.

The coding manner for bandwidth extension to the high-frequency audio signals is determined according to the characteristics of the audio signals/low-frequency audio signals such that a case that the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

Still another manner for selecting the bandwidth extension mode to code the high-frequency audio signals is to perform processing according to both the coding manner of the low-frequency audio signals and the characteristics of the audio signals/low-frequency audio signals. For example, when the low-frequency audio signals should be coded using the TD coding manner and the audio signals/low-frequency audio signals are voice signals, the TD-BWE mode is selected to perform TD coding for the high-frequency audio signals, when the low-frequency audio signals should be coded using the FD coding manner or the low-frequency audio signals should be coded using the TD coding manner, and the audio signals/low-frequency audio signals are music signals, the FD-BWE mode is selected to perform FD coding for the high-frequency audio signals.

Figure 6:
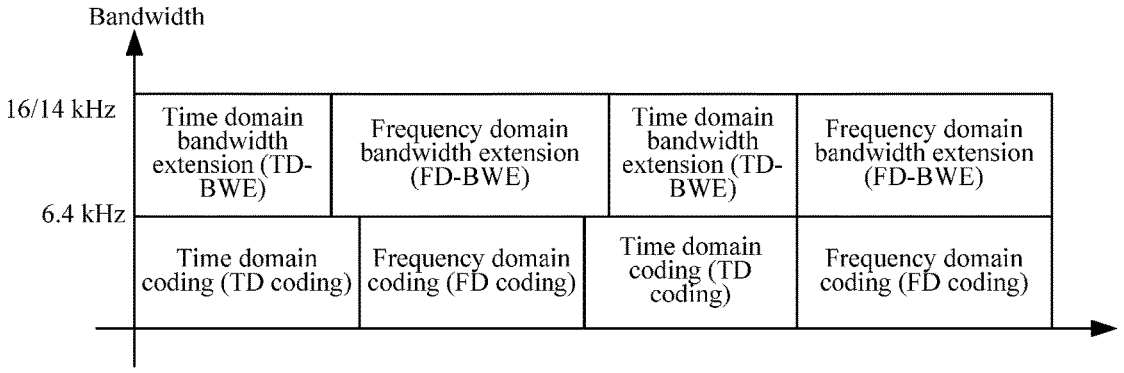
FIG. 6 is a third schematic diagram of bandwidth extension in the audio signal coding method according to an embodiment of the present disclosure.

FIG. 6 is a third schematic diagram of bandwidth extension in the audio signal coding method according to an embodiment of the present disclosure. As shown in FIG. 6, when low-frequency (0-6.4 kHz) audio signals are coded using TD coding, high-frequency (6.4-16/14 kHz) audio signals may be coded using FD coding of FD-BWE, or TD coding of TD-BWE, when the low-frequency (0-6.4 kHz) audio signals are coded using FD coding, the high-frequency (6.4-16/14 kHz) audio signals are also coded using the FD coding of the FD-BWE.

A coding manner for bandwidth extension to the high-frequency audio signals is determined according to a coding manner of the low-frequency audio signals and characteristics of the audio signals/low-frequency audio signals such that a case that the coding manner of the low-frequency audio signals and the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

In the audio signal coding method according to the embodiment of the present disclosure, the coding manner of the low-frequency audio signals may be the TD coding or the FD coding. In addition, two manners are available for bandwidth extension, that is, the TD-BWE and the FD-BWE, which may correspond to different low-frequency coding manners.

Delay in the TD-BWE and delay in the FD-BWE may be different, so delay alignment is required, to reach unified delay.

It is assumed that coding delay of all low-frequency audio signals is the same, it is better that the delay in the TD-BWE and the delay in the FD-BWE are the same. Generally, the delay in the TD-BWE is fixed, whereas the delay in the FD-BWE is adjustable. Therefore, unified delay may be implemented by adjusting the delay in the FD-BWE.

Figure 7:
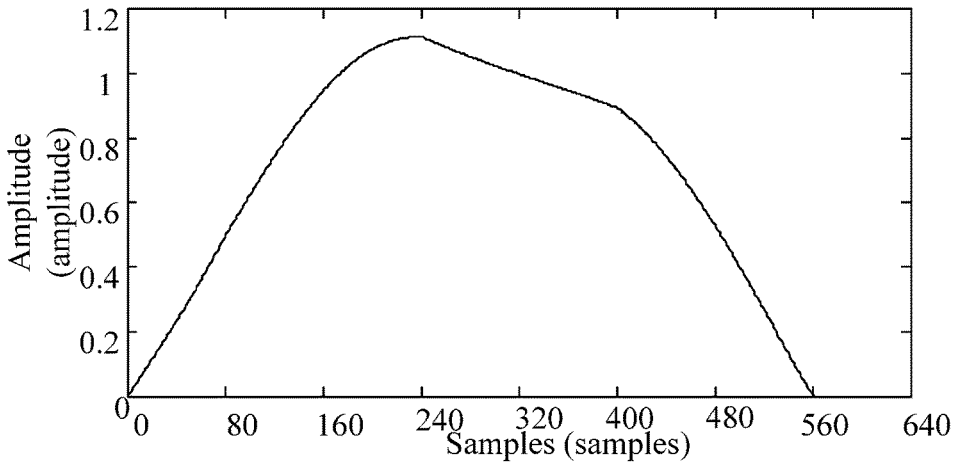
FIG. 7 is a schematic diagram of an analyzing window in ITU-Telecommunications (ITU-T) G.718.

According to this embodiment of the present disclosure, bandwidth extension with zero delay relative to the decoding of the low-frequency audio signals may be implemented. Here, the zero delay is relative to a low frequency band because an asymmetric window inheritably has delay. In addition, according to this embodiment of the present disclosure, different windowing may be performed for the high-frequency signals. Here, the asymmetric window is used, for example, the analyzing window in ITU-T G.718 illustrated in FIG. 7. Further, any delay between the zero delay relative to decoding of the low-frequency audio signals and the delay of a high-frequency window relative to decoding of the low-frequency audio signals can be implemented as shown in FIG. 8.

Figure 8:
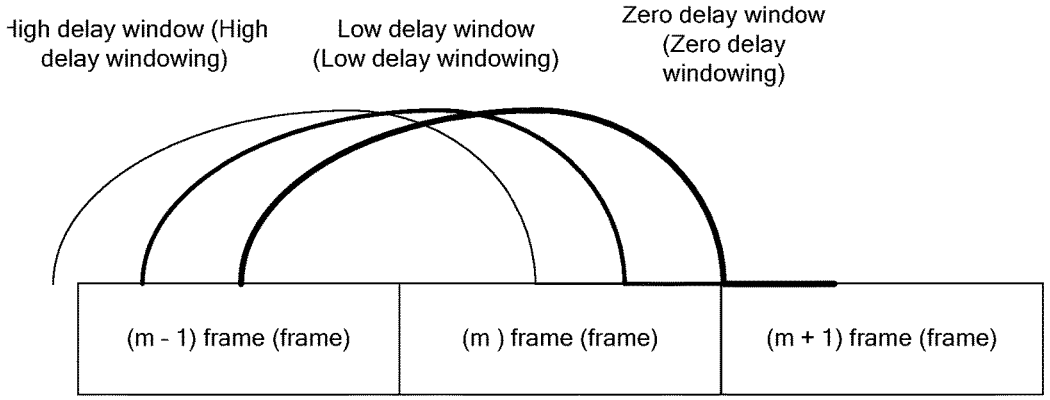
FIG. 8 is a schematic diagram of windowing of different high-frequency audio signals in the audio signal coding method according to the present disclosure.

FIG. 8 is a schematic diagram of windowing to different high-frequency audio signals in the audio signal coding method according to the present disclosure. As shown in FIG. 8, as regard different frames (frames), for example, a (m−1) frame, a (m) frame, and a (m+1) frame, the high delay windowing of the high-frequency signals, low delay windowing of the high-frequency signals, and zero delay windowing of the high-frequency signals may be implemented. Each delay windowing of the high-frequency signals does not consider the delay of the windowing, but considers only different windowing manners of the high-frequency signals.

Figure 9:
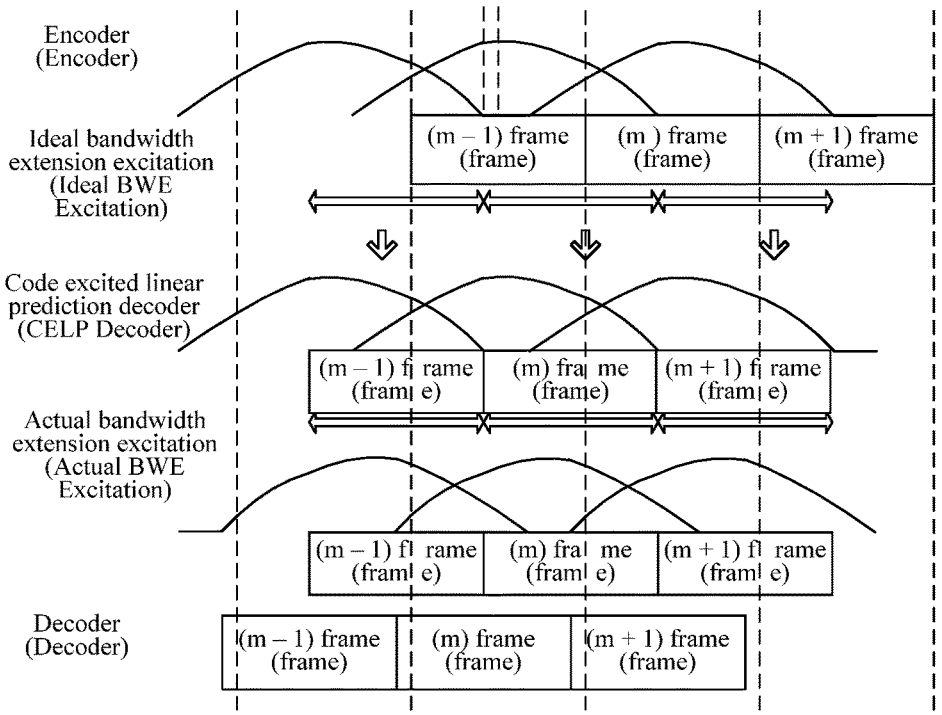
FIG. 9 is a schematic diagram of BWE based on high delay windowing of high-frequency signals in the audio signal coding method according to the present disclosure.

FIG. 9 is a schematic diagram of BWE based on high delay windowing of high-frequency signals in the audio signal coding method according to the present disclosure. As shown in FIG. 9, when low-frequency audio signals of input frames are completely decoded, the decoded low-frequency audio signals are used as high-frequency excitation signals. Windowing to the high-frequency audio signals of the input frames is determined according to the decoding delay of the low-frequency audio signals of the input frames.

For example, the coded and decoded low-frequency audio signal have the delay of D1 milliseconds (ms). When an Encoder encoder at a coding end performs time-frequency transforming for the high-frequency audio signals, time-frequency transforming is performed for the high-frequency audio signals having the delay of D1 ms, and the windowing transform of the high-frequency audio signals may generate the delay of D2 ms. Therefore, the total delay of the high-frequency signals decoded by a Decoder decoder at a decoding end is D1+D2 ms. In this way, compared with the decoded low-frequency audio signals, the high-frequency audio signals have the additional delay of D2 ms. That is, the decoded low-frequency audio signals need the additional delay of D2 ms to align with the delay of the decoded high-frequency audio signals such that the total delay of the output signals is D1+D2 ms. However, at the decoding end, because high-frequency excitation signals need to be obtained from prediction of the low-frequency audio signals, time-frequency transforming is performed for both the low-frequency audio signals at the decoding end and the high-frequency audio signals at the coding end. Time-frequency transforming is performed for both the high-frequency audio signals at the coding end and the low-frequency audio signals at the decoding end after the delay of D1 ms, so the excitation signals are aligned.

Figure 10:
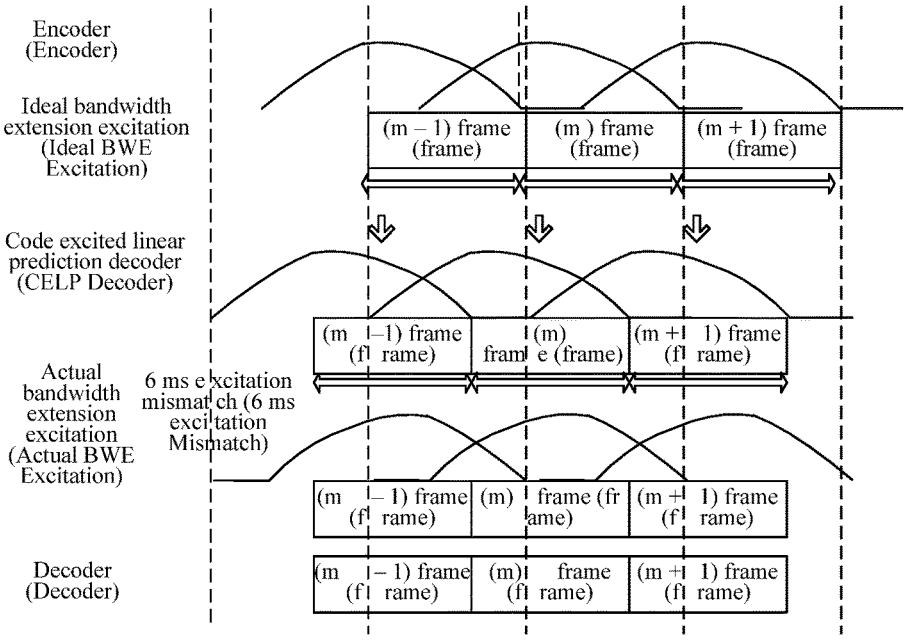
FIG. 10 is a schematic diagram of BWE based on zero delay windowing of high-frequency signals in the audio signal coding method according to the present disclosure.

FIG. 10 is a schematic diagram of BWE based on zero delay windowing of high-frequency signals in the audio signal coding method according to the present disclosure. As shown in FIG. 10, windowing is performed directly by a coding end for high-frequency audio signals of a currently received frame, during time-frequency transforming processing, a decoding end uses decoded low-frequency audio signals of a current frame as excitation signals. Although the excitation signals may be staggered, the impact of staggering may be ignored after the excitation signals are calibrated.

For example, the decoded low-frequency audio signals have the delay of D1 ms, whereas when the coding end performs time-frequency transforming for the high-frequency signals, delay processing is not performed, and windowing to the high-frequency signals may generate the delay of D2 ms, so the total delay of the high-frequency signals decoded at the decoding end is D2 ms.

When D1 is equal to D2, the decoded low-frequency audio signals do not need additional delay to align with the decoded high-frequency audio signals. However, the decoding end predicts that the high-frequency excitation signals are obtained from frequency signals that are obtained after time-frequency transforming is performed for the low-frequency audio signals that are delayed by D1 ms, so the high-frequency excitation signals do not align with low-frequency excitation signals, and the stagger of D1 ms exists. The decoded signals have the total delay of D1 ms or D2 ms, compared with the signals at the coding end.

When D1 is not equal to D2, for example, when D1 is smaller than D2, the decoded signals have the total delay of D2 ms compared with the signals at the coding end, the stagger between the high-frequency excitation signals and the low-frequency excitation signals is D1 ms, and the decoded low-frequency audio signals need the additional delay of (D2−D1) ms to align with the decoded high-frequency audio signals. For example, when D1 is larger than D2, the decoded signals have the total delay of D1 ms compared with the signals at the coding end, the stagger between the high-frequency excitation signals and the low-frequency excitation signals is D1 ms, and the decoded high-frequency audio signals need the additional delay of (D1−D2) ms to align with the decoded low-frequency audio signals.

The BWE between the zero-delay windowing and high-delay windowing of the high-frequency signals refers to that the coding end performs windowing for the high-frequency audio signals of the currently received frame after the delay of D3 ms. The delay ranges from 0 to D1 ms. During time-frequency transforming processing, the decoding end uses the decoded low-frequency audio signals of the current frame as the excitation signals. Although the excitation signals may be staggered, the impact of the stagger may be ignored after the excitation signals are calibrated.

When D1 is equal to D2, the decoded low-frequency audio signals need the additional delay of D3 ms to align with the high-frequency audio signals. However, the decoding end predicts that the high-frequency excitation signals are obtained from frequency signals that are obtained after time-frequency transforming is performed for the low-frequency audio signals that are delayed by D1 ms, so the high-frequency excitation signals do not align with the low-frequency excitation signals, and the stagger of D1−D3 ms exists. The decoded signals have the total delay of D2+D3 ms or D1+D3 ms compared with the signals at the coding end.

When D1 is not equal to D2, for example, when D1 is smaller than D2, the decoded signals have the total delay of (D2+D3) ms compared with the signals at the coding end, the stagger between the high-frequency excitation signals and the low-frequency excitation signals is (D1−D3) ms, and the decoded low-frequency audio signals need the additional delay of (D2+D3−D1) ms to align with the decoded high-frequency audio signals.

For example, when D1 is larger than D2, the decoded signals have the total delay of max (D1, D2+D3) ms compared with the signals at the coding end, the stagger between the high-frequency excitation signals and the low-frequency excitation signals is (D1−D3) ms, where max (a, b) indicates that a larger value between a and b is taken. When max (D1, D2+D3)=D2+D3, the decoded low-frequency audio signals need the additional delay of (D2+D3−D1) ms to align with the decoded high-frequency audio signals, when max (D1, D2+D3)=D1, the decoded high-frequency audio signals need the additional delay of (D1−D2−D3) ms to align with the decoded low-frequency audio signals. For example, when D3=(D1−D2) ms, the decoded signals have the total delay of D1 ms compared with the signals at the coding end, the stagger between the high-frequency excitation signals and the low-frequency excitation signals is D2 ms. In this case, the decoded low-frequency audio signals do not need the additional delay to align with the decoded high-frequency audio signals.

Therefore, in this embodiment of the present disclosure, during the TD-BWE, the status of the FD-BWE needs to be updated because a next frame may use the FD-BWE. Similarly, during the FD-BWE, the status of the TD-BWE needs to be updated because a next frame may use the TD-BWE. In this manner, continuity of bandwidth switching is implemented.

Figure 11:
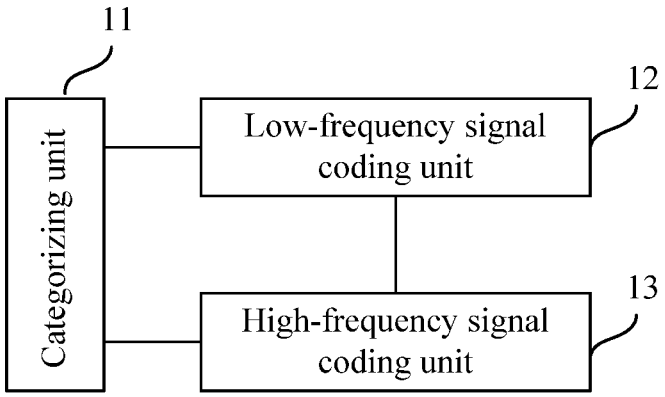
FIG. 11 is a schematic diagram of an audio signal processing apparatus according to an embodiment of the present disclosure.

The above embodiments are directed to the audio signal coding method according to the present disclosure, which may be implemented using an audio signal processing apparatus. FIG. 11 is a schematic diagram of an audio signal processing apparatus according to an embodiment of the present disclosure. As shown in FIG. 11, the signal processing apparatus provided in this embodiment of the present disclosure includes a categorizing unit 11, a low-frequency signal coding unit 12, and a high-frequency signal coding unit 13.

The categorizing unit 11 is configured to categorize audio signals into high-frequency audio signals and low-frequency audio signals. The low-frequency signal coding unit 12 is configured to code the low-frequency audio signals using a corresponding low-frequency coding manner according to characteristics of the low-frequency audio signals, where the coding manner may be a TD coding manner or a FD coding manner. For example, as regard voice audio signals, low-frequency voice signals are coded using TD coding, as regard music audio signals, low-frequency music signals are coded using FD coding. Generally, a better effect is achieved when the voice signals are coded using the TD coding, whereas a better effect is achieved when the music signals are coded using the FD coding.

The high-frequency signal coding unit 13 is configured to select a bandwidth extension mode to code the high-frequency audio signals according to the low-frequency coding manner and/or characteristics of the audio signals.

In an embodiment, if the low-frequency signal coding unit 12 uses the TD coding, the high-frequency signal coding unit 13 selects a TD-BWE mode to perform TD coding or FD coding for the high-frequency audio signals, if the low-frequency signal coding unit 12 uses the FD coding, the high-frequency signal coding unit 13 selects a FD-BWE mode to perform TD coding or FD coding for the high-frequency audio signals.

In addition, if the audio signals/low-frequency audio signals are voice audio signals, the high-frequency signal coding unit 13 codes the high-frequency voice signals using the TD coding, if the audio signals/low-frequency audio signals are music audio signals, the high-frequency signal coding unit 13 codes the high-frequency music signals using the FD coding. In this case, the coding manner of the low-frequency audio signals is not considered.

Further, when the low-frequency signal coding unit 12 codes the low-frequency audio signals using the TD coding manner, and the audio signals/low-frequency audio signals are voice signals, the high-frequency signal coding unit 13 selects the TD-BWE mode to perform TD coding for the high-frequency audio signals, when the low-frequency signal coding unit 12 codes the low-frequency audio signals using the FD coding manner or the low-frequency signal coding unit 12 codes the low-frequency audio signals using the TD coding manner and the audio signals/low-frequency audio signals are music signals, the high-frequency signal coding unit 13 selects the FD-BWE mode to perform FD coding for the high-frequency audio signals.

Figure 12:
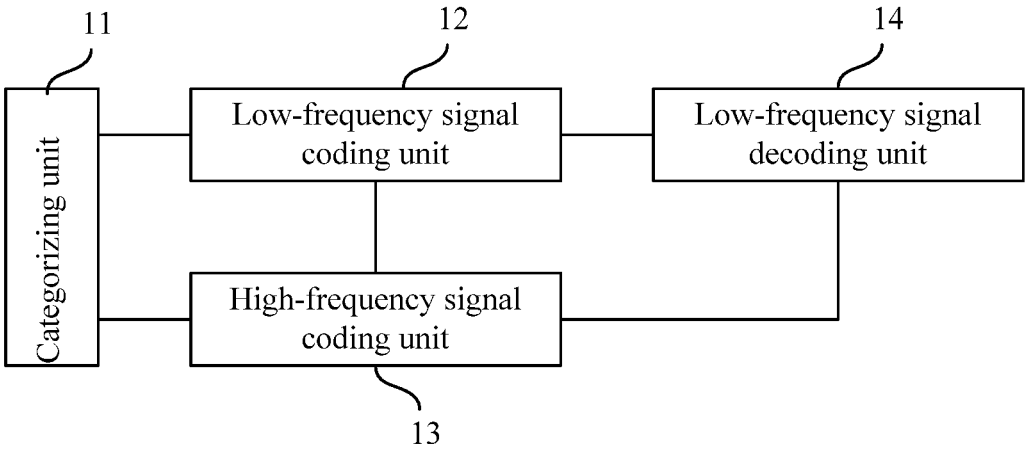
FIG. 12 is a schematic diagram of another audio signal processing apparatus according to an embodiment of the present disclosure.

FIG. 12 is a schematic diagram of another audio signal processing apparatus according to an embodiment of the present disclosure. As shown in FIG. 12, the signal processing apparatus according to this embodiment of the present disclosure further includes a low-frequency signal decoding unit 14.

The low-frequency signal decoding unit 14 is configured to decode the low-frequency audio signals, where first delay D1 is generated during the coding and decoding of the low-frequency audio signals.

In an embodiment, if the high-frequency audio signals have a delay window, the high-frequency signal coding unit 13 is configured to code the high-frequency audio signals after delaying the high-frequency audio signals by the first delay D1, where second delay D2 is generated during the coding of the high-frequency audio signals such that coding delay and decoding delay of the audio signals are the sum of the first delay D1 and a second delay D2, that is, (D1+D2).

If the high-frequency audio signals have no delay window, the high-frequency signal coding unit 13 is configured to code the high-frequency audio signals, where the second delay D2 is generated during the coding of the high-frequency audio signals. When the first delay D1 is smaller than or equal to the second delay D2, after coding the low-frequency audio signals, the low-frequency signal coding unit 12 delays the coded low-frequency audio signals by the difference (D2−D1) between the second delay D2 and the first delay D1 such that coding delay and decoding delay of the audio signals are the second delay D2, when the first delay D1 is larger than the second delay D2, the low-frequency signal coding unit 12 is configured to after coding the high-frequency audio signals, delay the coded high-frequency audio signals by the difference (D1−D2) between the first delay D1 and the second delay D2 such that coding delay and decoding delay of the audio signals are the first delay D1.

If the high-frequency audio signals have a delay window whose delay is between zero and a high delay, the high-frequency signal coding unit 13 is configured to, after delaying the high-frequency audio signals by third delay D3, code the delayed high-frequency audio signals, where the second delay D2 is generated during the coding of the high-frequency signals. When the first delay is smaller than or equal to the second delay, after coding the low-frequency audio signals, the low-frequency signal coding unit 12 delays the coded low-frequency audio signals by the difference (D2+D3−D1) between the sum of the second delay D2 and the third delay D3, and the first delay D1 such that coding delay and decoding delay of the audio signals are the sum of the second delay D2 and the third delay D3, that is, (D2+D3). When the first delay is larger than the second delay, two possibilities exist: if the first delay D1 is larger than or equal to the sum (D2+D3) of the second delay D2 and the third delay D3, after coding the high-frequency audio signals, the high-frequency signal coding unit 13 delays the coded high-frequency audio signals by the difference (D1−D2−D3) between the first delay D1 and the sum of the second delay D2 and the third delay D3, if the first delay D1 is smaller than the sum (D2+D3) of the second delay D2 and the third delay D3, after coding the low-frequency audio signals, the low-frequency signal coding unit 12 delays the coded low-frequency audio signals by the difference (D2+D3−D1) between the sum of the second delay D2 and the third delay D3, and the first delay D1 such that coding delay and decoding delay of the audio signals are the first delay D1 or the sum (D2+D3) of the second delay D2 and the third delay D3.

With the audio signal coding apparatus provided in this embodiment of the present disclosure, the coding manner for bandwidth extension to the high-frequency audio signals may be determined according to the coding manner of the low-frequency audio signals and the characteristics of the audio signals/low-frequency audio signals such that a case that the coding manner of the low-frequency audio signals and the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

Those skilled in the art may further understand that the exemplary units and algorithm steps described in the embodiments of the present disclosure may be implemented in the form of electronic hardware, computer software, or the combination of the hardware and software. To clearly describe the exchangeability of the hardware and software, the constitution and steps of each embodiment are described by general functions. Whether the functions are implemented in hardware or software depends on specific applications of the technical solutions and limitation conditions of the design. Those skilled in the art may use different methods to implement the described functions for the specific applications. However, the implementation shall not be considered to go beyond the scope of the present disclosure.

The steps of the method or algorithms according to the embodiments of the present disclosure can be executed by the hardware or software module enabled by the processor, or executed by a combination thereof. The software module may be stored in a random access memory (RAM), a memory, a read-only memory (ROM), an electrically programmable ROM, an electrically erasable programmable ROM, a register, a hard disk, a movable hard disk, a compact disc-read only memory (CD-ROM), or any other storage medium commonly known in the art.

The objectives, technical solutions, and beneficial effects of the present disclosure are described in detail in above embodiments. It should be understood that the above descriptions are only about the exemplary embodiments of the present disclosure, but not intended to limit the protection scope of the present disclosure. Any modification, equivalent replacement, and improvement made without departing from the idea and principle of the present disclosure shall fall into the protection scope of the present disclosure.

What is claimed is:

1. An audio signal coding method, comprising:

categorizing audio signals into high-frequency audio signals and low-frequency audio signals;

coding the low-frequency audio signals using at least one of a time domain (TD) coding manner or a frequency domain (FD) coding manner; and selecting a bandwidth extension mode to code the high-frequency audio signals according to at least one of a low-frequency coding manner by:

selecting a time domain bandwidth extension (TD-BWE) mode to perform TD coding for the high-frequency audio signals when the low-frequency audio signals should be coded using the TD coding manner; and selecting a frequency domain bandwidth extension (FD-BWE) mode to perform FD coding for the high-frequency audio signals when the low-frequency audio signals should be coded using the FD coding manner.

2. The audio signal coding method according to claim 1, further comprising performing delay processing on the high-frequency audio signals or the low-frequency audio signals such that delay of the high-frequency audio signals and delay of the low-frequency audio signals are the same at a decoding end.

3. The audio signal coding method according to claim 1, wherein the coding the high-frequency audio signals comprises coding the high-frequency audio signals after performing first delay for the high-frequency audio signals such that coding delay and decoding delay of the audio signals are a sum of the first delay and second delay, wherein the first delay is delay generated during coding and decoding of the low-frequency audio signals, and wherein the second delay is delay generated during coding of the high-frequency audio signals.

4. The audio signal coding method according to claim 1, wherein the low-frequency audio signals are delayed by a difference between the second delay and the first delay after being coded when the first delay is smaller than or equal to than the second delay such that coding delay and decoding delay of the audio signals are the second delay, wherein the high-frequency audio signals are delayed by a difference between the first delay and the second delay after being coded when the first delay is larger than the second delay such that coding delay and decoding delay of the audio signals are the first delay, wherein the first delay is delay generated during coding and decoding of the low-frequency audio signals, and wherein the second delay is delay generated during coding of the high-frequency audio signals.

5. The audio signal coding method according to claim 1, wherein coding the high-frequency audio signals comprises coding the high-frequency audio signals after performing third delay for the high-frequency audio signals, wherein the low-frequency audio signals are delayed by a difference between a sum of the second delay and the third delay and the first delay after being coded when the first delay is smaller than or equal to the second delay such that coding delay and decoding delay of the audio signals are the sum of the second delay and the third delay, wherein the high-frequency audio signals are delayed by a difference between the first delay and a sum of the second delay and the third delay after being coded when the first delay is larger than the second delay, or the low-frequency audio signals are delayed by a difference between a sum of the second delay and the third delay and the first delay when the first delay is larger than the second delay such that coding delay and decoding delay of the audio signals are the first delay or the sum of the second delay and the third delay.

6. An audio signal coding apparatus, comprising:

a processor configured to:

categorize audio signals into high-frequency audio signals and low-frequency audio signals;

code the low-frequency audio signals using at least one of a time domain (TD) coding manner or a frequency domain (FD) coding manner; and select a bandwidth extension mode to code the high-frequency audio signals according to a low-frequency coding manner by:

selecting a time domain bandwidth extension (TD-BWE) mode to perform TD coding for the high-frequency audio signals when the low-frequency audio signals should be coded using the TD coding manner; and selecting a frequency domain bandwidth extension (FD-BWE) mode to perform FD coding for the high-frequency audio signals when the low-frequency audio signals should be coded using the FD coding manner.

7. The audio signal coding apparatus according to claim 6, wherein the processor is further configured to:

decode the low-frequency audio signals, wherein first delay is generated during the coding and decoding of the low-frequency audio signals;

code the delayed high-frequency audio signals after delaying the high-frequency audio signals by the first delay such that coding delay and decoding delay of the audio signals are a sum of the first delay and second delay, wherein the second delay is generated during the coding of the high-frequency audio signals.

8. The audio signal coding apparatus according to claim 6, wherein the processor is further configured to:

delay the coded low-frequency audio signals by a difference between the second delay and the first delay when the first delay is smaller than or equal to the second delay after coding the low-frequency audio signals such that coding delay and decoding delay of the audio signals are the second delay; and delay the coded high-frequency signals by a difference between the first delay and the second delay when the first delay is larger than the second delay after coding the high-frequency audio signals such that coding delay and decoding delay of the audio signals are the first delay, wherein the first delay is delay generated during coding and decoding of the low-frequency audio signals, and wherein the second delay is delay generated during coding of the high-frequency audio signals.

9. The audio signal coding apparatus according to claim 6, wherein the processor is further configured to:

code the high-frequency audio signals after performing third delay for the high-frequency audio signals; and delay the coded low-frequency audio signals by a difference between a sum of the second delay and the third delay and the first delay when the first delay is smaller than or equal to the second delay after coding the low-frequency audio signals such that coding delay and decoding delay of the audio signals are the sum of the second delay and the third delay;

delay the coded high-frequency audio signals by a difference between the first delay and a sum of the second delay and the third delay when the first delay is larger than the second delay after coding the high-frequency audio signals; or delay the coded low-frequency audio signals by a difference between a sum of the second delay and the third delay and the first delay when the first delay is larger than the second delay after coding the low-frequency audio signals such that coding delay and decoding delay of the audio signals are the first delay or the sum of the second delay and the third delay, wherein the first delay is delay generated during coding and decoding of the low-frequency audio signals, and wherein the second delay is delay generated during coding of the high-frequency audio signals.

10. An audio signal coding method, comprising:

categorizing audio signals into high-frequency audio signals and low-frequency audio signals;

coding the low-frequency audio signals using at least one of a time domain (TD) coding manner or a frequency domain (FD) coding manner;

selecting a time domain bandwidth extension (TD-BWE) mode to perform TD coding for the high-frequency audio signals when the low-frequency audio signals should be coded using the TD coding manner and the audio signals are voice signals; and selecting a frequency domain bandwidth extension (FD-BWE) mode to perform FD coding for the high-frequency audio signals when at least one of the low-frequency audio signals do not need to be coded using the TD coding manner or the audio signals are not voice signals.

11. An audio signal coding apparatus, comprising:

a memory comprising instructions; and a processor coupled to the memory and that, when the instructions are executed, is configured to:

categorize audio signals into high-frequency audio signals and low-frequency audio signals;

code the low-frequency audio signals using at least one of a time domain (TD) coding manner or a frequency domain (FD) coding manner select a time domain bandwidth extension (TD-BWE) mode to perform TD coding for the high-frequency audio signals when the low-frequency audio signals should be coded using the TD coding manner and the audio signals are voice signals; and select a frequency domain bandwidth extension (FD-BWE) mode to perform FD coding for the high-frequency audio signals when the low-frequency audio signals do not need to be coded using the TD coding manner or the audio signals are not voice signals.

* * * * *